United States Patent [19]

Kraft

[11] 4,004,676

[45] Jan. 25, 1977

[54] ESCALATOR WITH NON-JAMING STEP

[75] Inventor: Joseph K. Kraft, Gettysburg, Pa.

[73] Assignee: Westinghouse Electric Corporation, Pittsburgh, Pa.

[22] Filed: July 17, 1975

[21] Appl. No.: 596,794

[52] U.S. Cl. ..... 198/326

[51] Int. Cl.[2] ..... B66B 9/12

[58] Field of Search ..... 198/16, 16 MS, 17, 18

[56] References Cited

UNITED STATES PATENTS

| | | | |
|---|---|---|---|
| 2,981,391 | 4/1961 | Hansen | 198/16 |
| 3,515,253 | 6/1970 | Yamada | 198/17 |

*Primary Examiner*—Evon C. Blunk
*Assistant Examiner*—Douglas D. Watts
*Attorney, Agent, or Firm*—D. R. Lackey

[57] ABSTRACT

Transportation apparatus for transporting persons between spaced landings, including a plurality of steps, and skirt members disposed at opposite sides of the steps. The steps each include tread and riser parts which cooperatively define projections on the riser side of the step adjacent to the skirt members. The projections on the step form an obtuse angle between the skirt members and the immediately adjacent portions of the riser part.

16 Claims, 6 Drawing Figures

ESCALATOR WITH NON-JAMING STEP

BACKGROUND OF THE INVENTION

1. Field of the Invention

The invention relates in general to transportation apparatus, and more specifically to moving stairways for transporting people between spaced landings.

2. Description of the Prior Art

U.S. Pat. No. 2,981,397, which is assigned to the same assignee as the present application, discloses several embodiments of movable stairways directed to reducing the possibility of objects entering and being caught between relatively movable portions of the stairway. The arrangements disclosed in this patent minimize the possibility of certain types of accidents, such as those which occur between the riser and tread parts of adjacent steps, and it would be desirable to provide new and improved stairway part arrangements which minimize the possibility of objects entering and being caught between the step and skirt guards, especially when the steps are changing from the step to the platform formation.

SUMMARY OF THE INVENTION

Briefly, the present invention is a new and improved movable stairway constructed to reduce the possibility of soft, flexible articles wedging between the step riser and skirt. The steps each include a tread part and a riser part. The tread part, adjacent each skirt board or guard, is extended beyond the normal front edge of the step, and the riser part angles outwardly from its normal position to cooperate with the extended portion of the tread part and provide step projections which have a triangular cross-section plan configuration. These extensions or projections on the step adjacent each skirt board provide a fillet or cove corner between the skirt-riser intersection which eliminates the normal 90° angle between the riser part and skirt board. The edge of the thread part which is opposite to the riser edge of the step, adjacent each skirt board, extends inwardly to provide recesses sized to receive the projections on the adjacent step, with the same small clearance being maintained between the recess and projection as maintained between other portions of adjacent steps.

Cleats and grooves on the treadboard are continued on the projecting portion of the treadboard, and if the riser is cleated, the cleats and grooves of the riser are also provided on the portion of the riser which cooperates with the treadboard extensions, to provide the projecting portions of the step.

In a preferred embodiment of the invention, the steps are of unitary construction and the tread and riser parts are both cleated. The steps are formed of two or three unitary sections, with the number depending upon the step width, placed in side-by-side relation and joined together to complete the step. In each section the tread and riser parts are integral, and the projection which forms the fillet or cove corner on the sections which are adjacent the skirts are integrally formed with cooperative tread and riser parts. The wheel axle supports and axle clamping members are also integrally formed with certain of the sections.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF PREFERRED EMBODIMENTS

Figure 1:
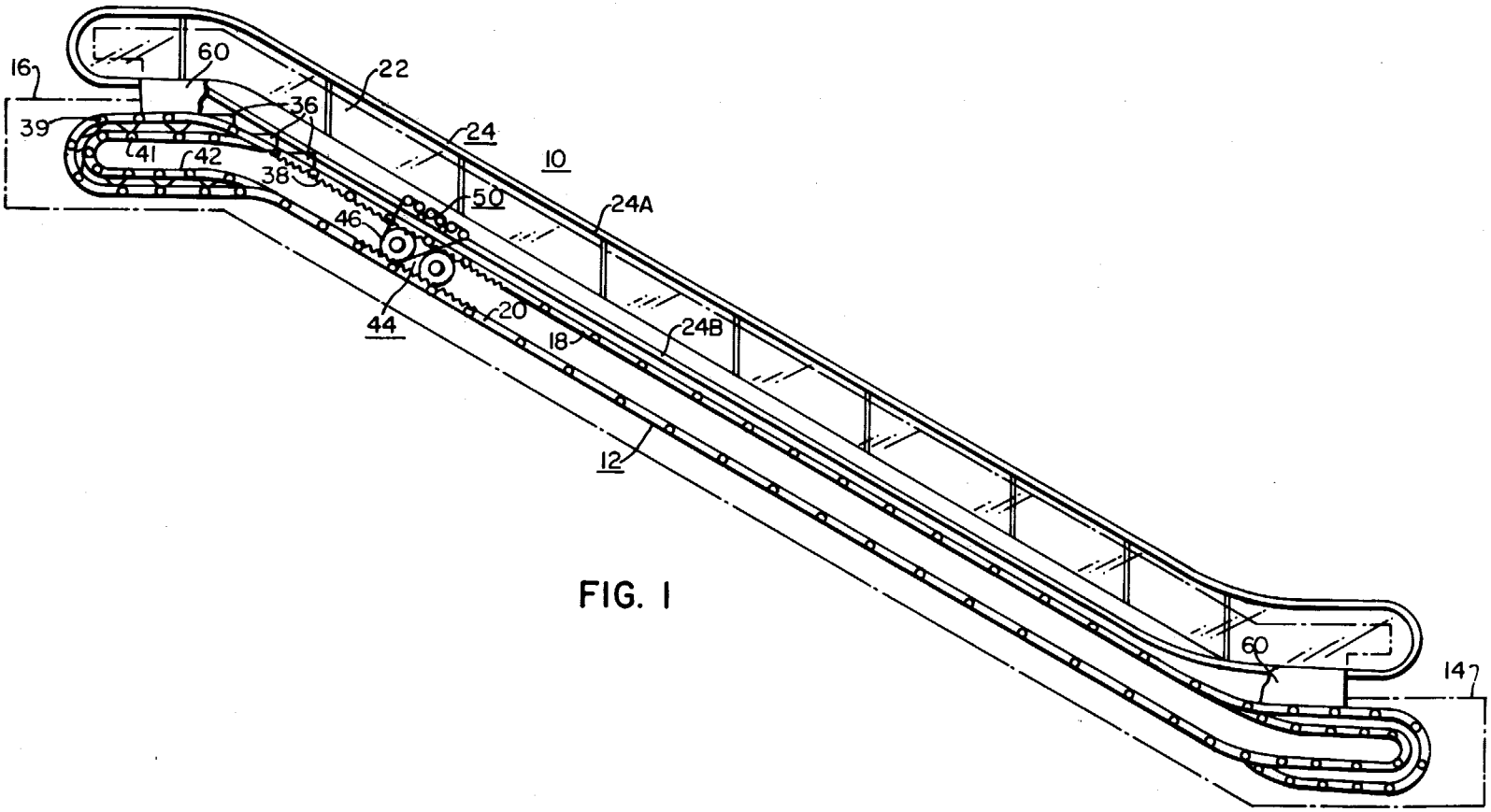
FIG. 1 is a side elevation of transportation apparatus of the general type which may be constructed according to the teachings of the invention.

Referring now to the drawings, and FIG. 1 in particular, there is shown a transportation device 10 of the type which may utilize the teachings of the invention. Device 10 employs a conveyor 12 for transporting passengers between a first landing 14 and a second landing 16. The conveyor 12 is of the endless type conventionally used in electric stairways. Conveyor 12 includes an upper load run 18 on which passengers stand while being transported between the landings, and a lower return run 20.

A balustrade 22 is disposed above the conveyor 12 for guiding a continuous, flexible handrail 24. The balustrade guides the handrail 24 as it moves about a closed loop which includes an upper run 24A during which a surface of the handrail 24 may be grasped by passengers as they are transported along the conveyor 12, and a lower return run 24B. The balustrade 22 may be transparent, as indicated, or opaque, as desired. The handrail 24 is guided around the balustrade by suitable guide means, such as a T-shaped guide which is located within the C-shaped cross-section of the handrail 24.

Conveyor 12 includes a plurality of steps 36, only a few of which are shown in FIG. 1. The steps 36 are each clamped to a step axle 39 and they move in a closed path, with the conveyor 12 being driven in a conventional manner, such as illustrated in U.S. Pat. No. 3,414,109, or the conveyor 12 may be driven by a modular drive arrangement as disclosed in U.S. Pat. No. 3,677,388, both of which are assigned to the same assignee as the present application. For purposes of example, the modular drive arrangement is shown in FIG. 1.

As disclosed in U.S. Pat. No. 3,677,388, the conveyor 12 includes an endless belt formed of toothed links 38, interconnected by the step axles to which the steps 36 are connected. The steps 36 are supported by main and trailer rollers 39 and 41, respectively, which cooperate with main and trailer tracks 40 and 42, respectively, to guide the steps in the endless path.

The steps are driven by a modular drive unit 44 which includes sprocket wheels and a drive chain for engaging the toothed links. The modular drive unit 44 includes a handrail drive pulley 46 on each side of the conveyor, which drives the handrail drive units 50 disposed on both sides of the conveyor 12. The handrail drive units 50 on each side of the conveyor 12 are of similar construction, and additional handrail drive units are provided when additional modular drive units are required on longer runs.

A skirt, commonly called a skirt board or skirt guard, is disposed immediately adjacent the sides of the steps 36, such as skirt 60 shown in fragmentary form in FIG. 1. The skirt 60 is a metallic panel which is disposed adjacent the sides of the steps with a maximum clearance between the skirt and the sides of the moving steps being about 3/16 inch (4.75 mm).

FIGS. 2, 3, 4 and 5 illustrate a new and improved step construction which may be used for the steps 36 shown in the transportation apparatus of FIG. 1, which steps cooperate with one another and with other stairway parts, such as the skirt boards 60, to provide a new and improved movable stairway which minimizes the possibility of objects becoming wedged between the steps and the skirt boards.

Figure 2:
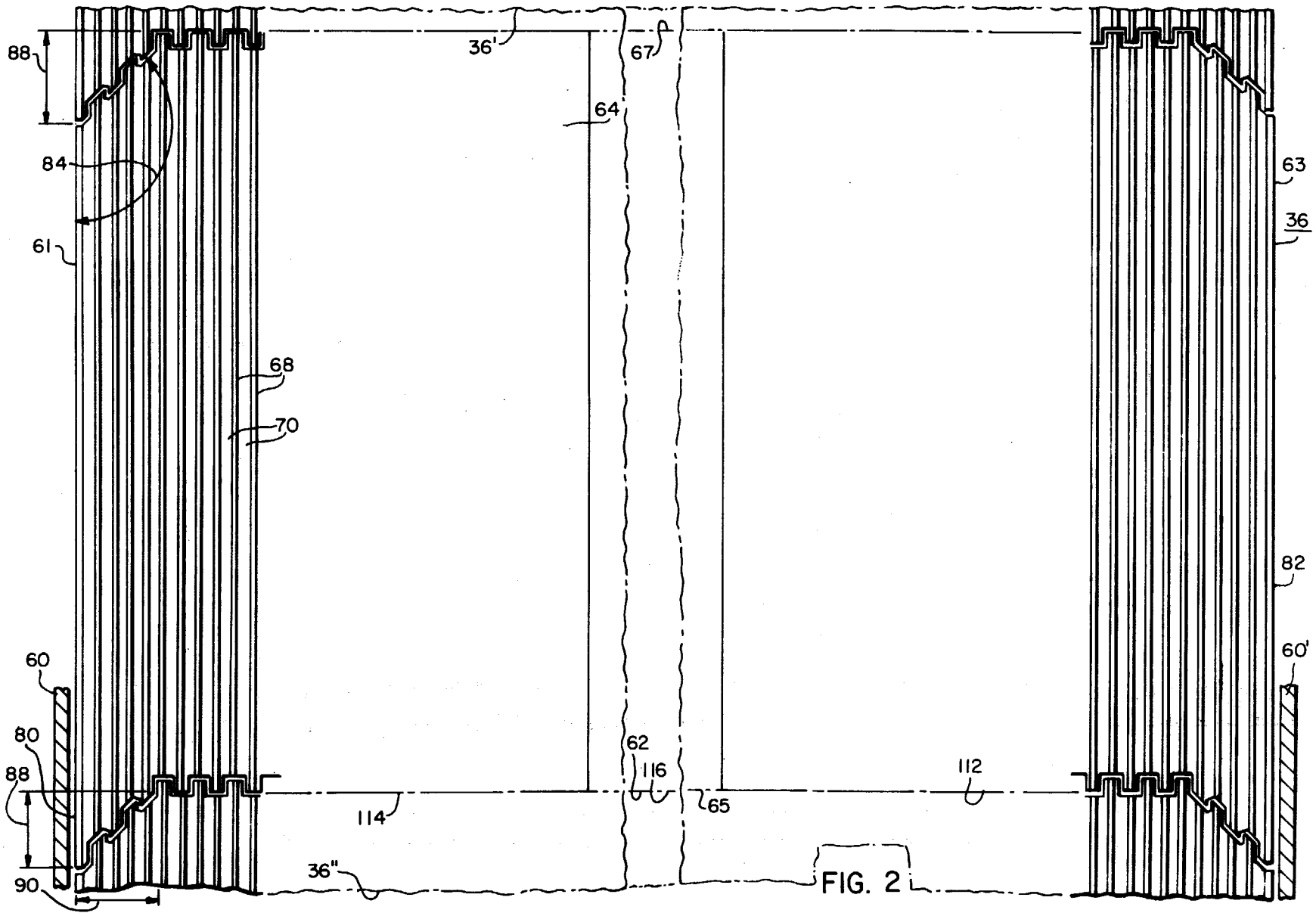
FIG. 2 is a plan view of a step suitable for the transportation apparatus shown in FIG. 1, constructed according to the teachings of the invention.
Figure 3:
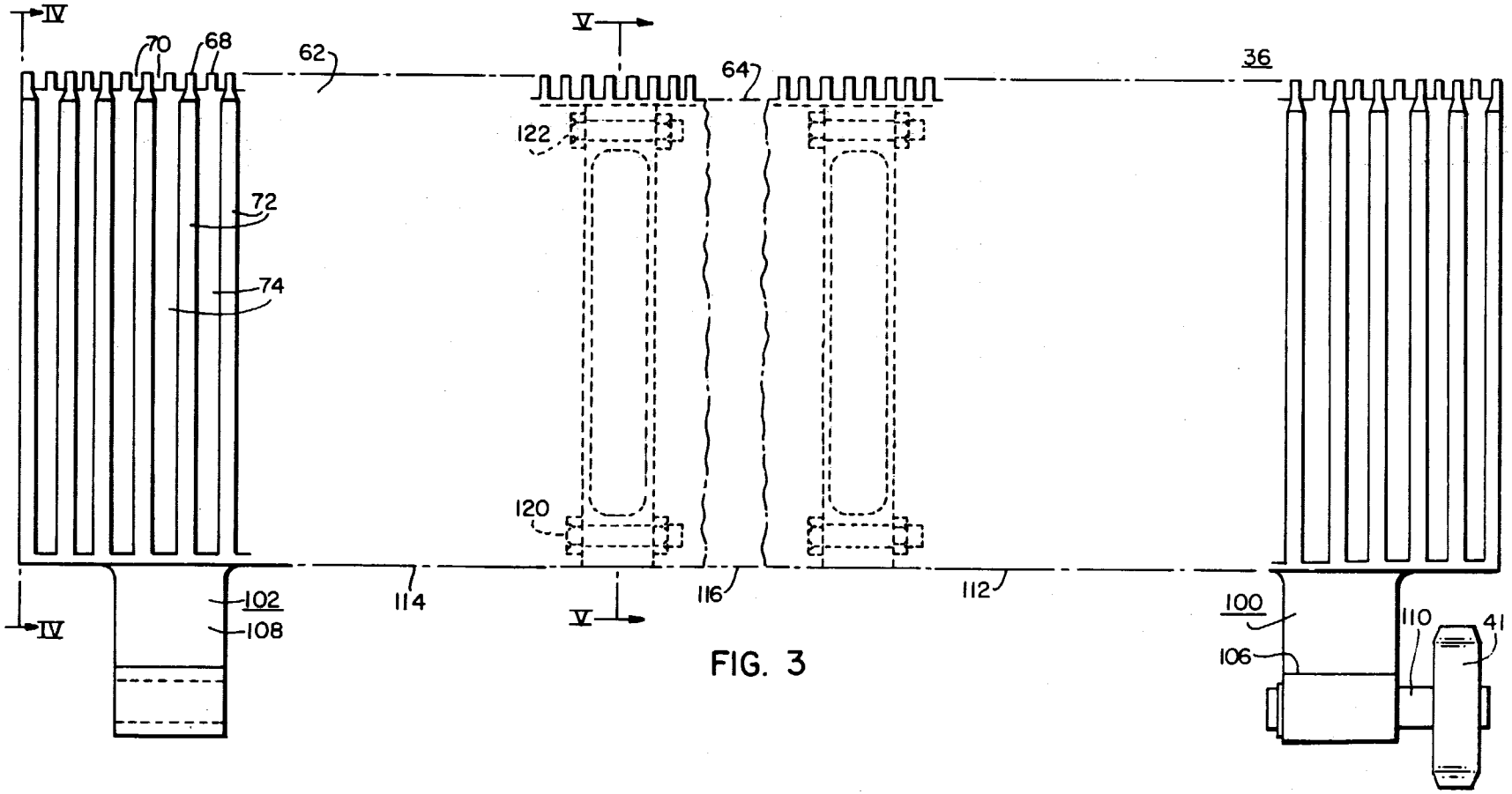
FIG. 3 is an elevational view of the riser side of the step shown in FIG. 2.
Figure 4:
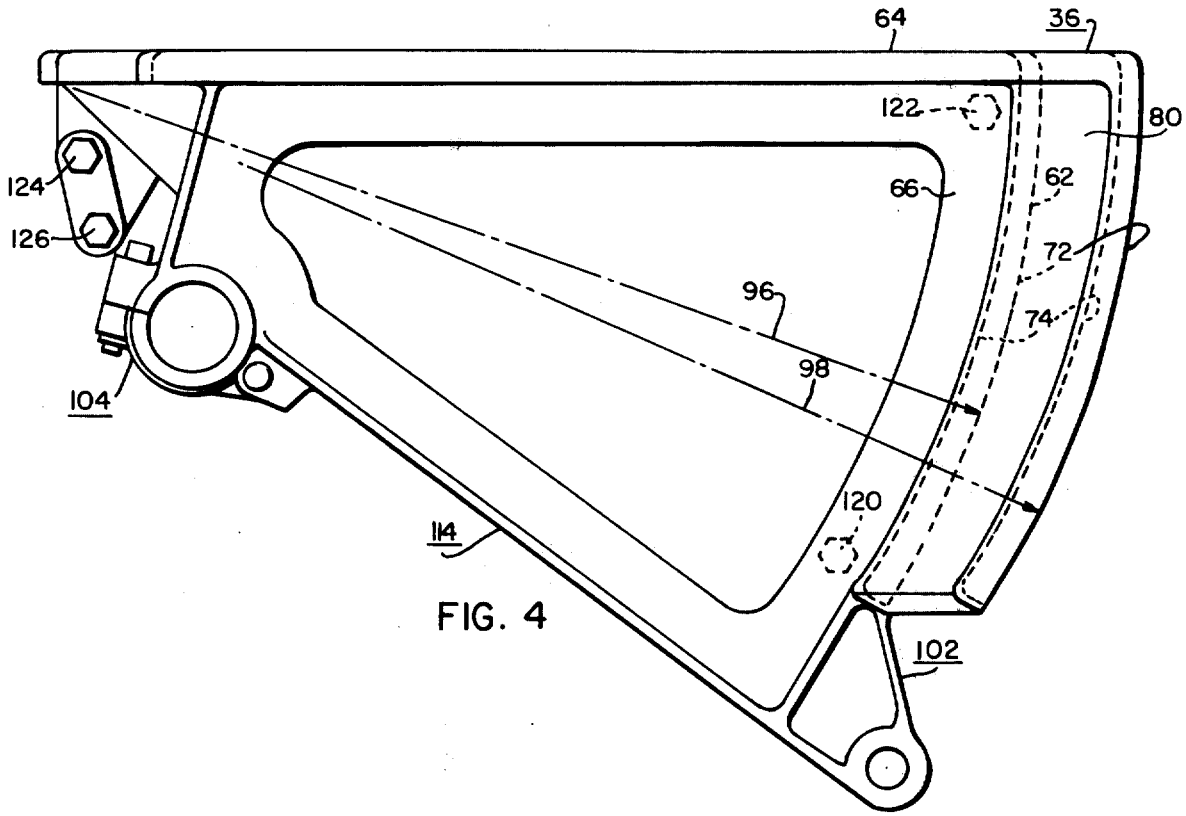
FIG. 4 is a side elevational view of the step shown in FIG. 3, taken in the direction of arrows IV—Iv.
Figure 5:
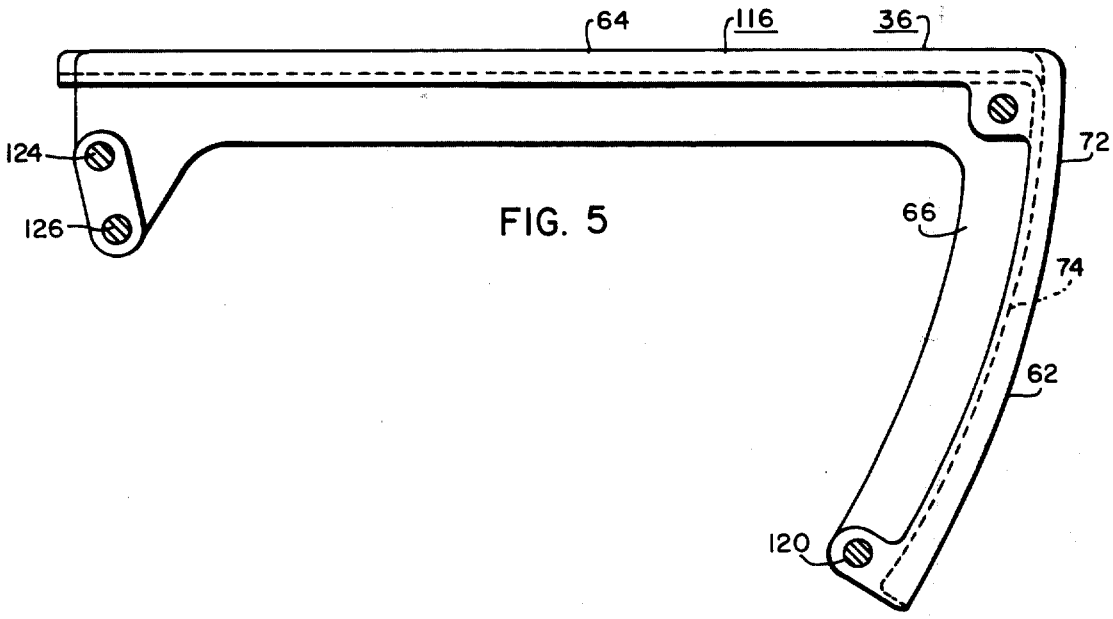
FIG. 5 is a side elevational view of the center section of the step shown in FIG. 3, taken in the direction of arrows V—V.
Figure 6:
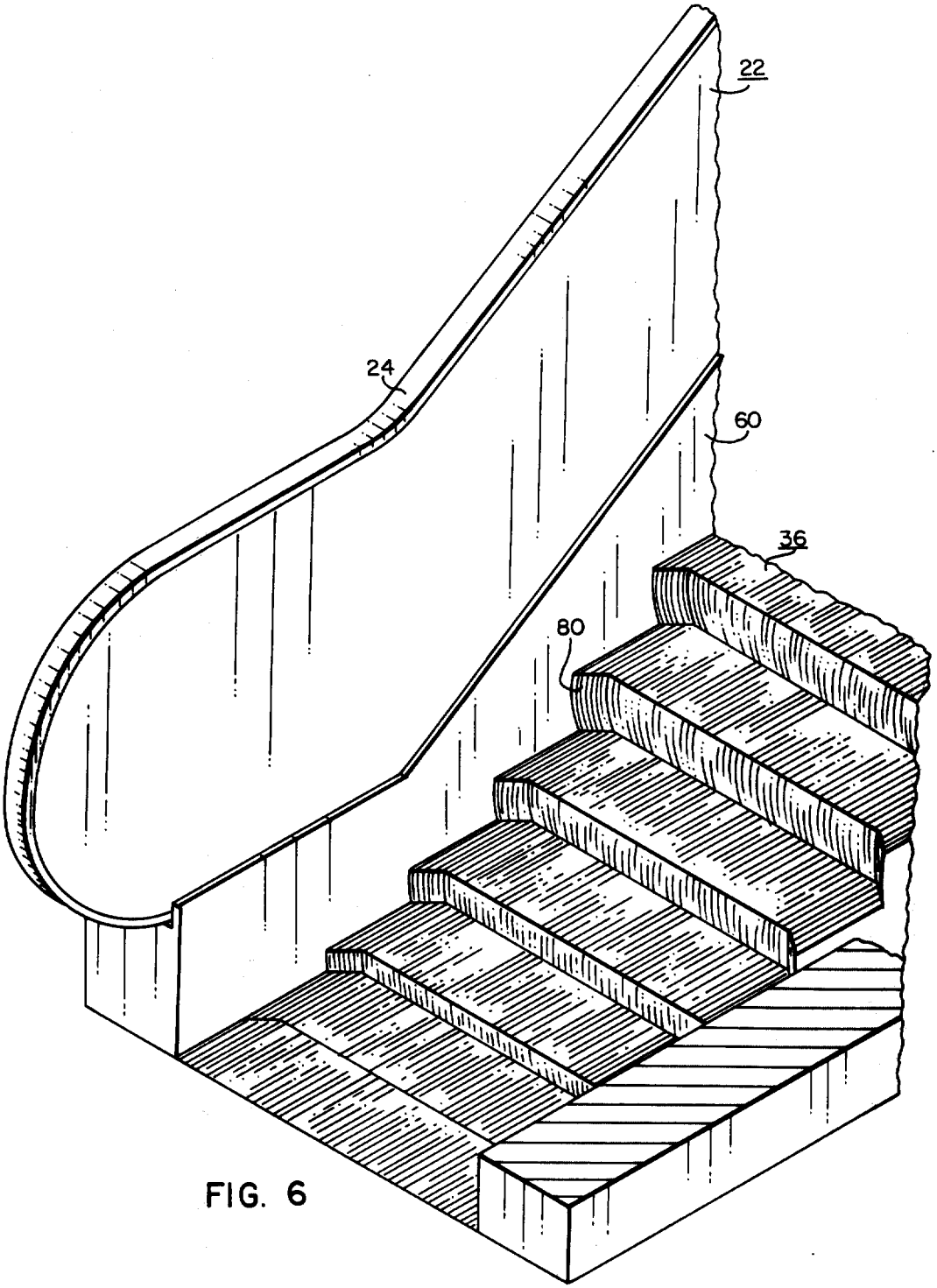
FIG. 6 is a fragmentary, perspective view of a movable stairway, such as the transportation apparatus of FIG. 1, constructed according to the teachings of the invention.

More specifically, FIG. 2 is a plan view of step 36 which also illustrates the immediately adjacent portions of the next higher step 36' and the next lower step 36'', as well as portions of the left and right hand skirt boards 60 and 60', respectively. FIG. 3 is a front elevational view of step 36, facing the riser side of the step, and FIG. 4 is a side elevational view of the step 36 shown in FIG. 3. FIG. 5 will be hereinafter referred to when describing a preferred embodiment of the step 36.

Step 36, as best shown in the plan view of FIG. 2 has first and second sides 61 and 63 and front and rear edges 65 and 67, respectively. Step 36 includes a riser part 62 at the front of the step and a tread part 64, both secured to a yoke 66. The riser 62 and yoke 66 are conventionally of integral construction, and as will be hereinafter described, in a preferred embodiment of the invention the riser, yoke and tread are of integral construction.

The tread 64 is provided with a plurality of cleats 68 and grooves 70 which extend in the direction of stairway travel, i.e., between the front and rear edges 65 and 67. The grooves 70 mesh with the teeth of the comb plates disposed at each of the landings 14 and 16 shown in FIG. 1. As illustrated in FIG. 2, the tread cleats of step 36 are aligned with the tread cleats on each of the other steps.

The riser 62 has vertically extending cleats 72 and grooves 74. The centerlines of the riser cleats 72 are aligned with alternate tread cleats 68, and the centerlines of the riser grooves 74 are aligned with the intervening cleats. Other cleat and groove arrangements may also be used, such as disclosed in the hereinbefore mentioned U.S. Pat. No. 2,981,397.

In accordance with the invention, the step 36 has projecting portions 80 and 82 on the riser side of the step adjacent each of the skirt boards. The projections 80 and 82 are cooperatively formed by the tread and riser parts. The tread 64 is modified adjacent each skirt 60 and 60' to extend outwardly past the normal front edge 62 to provide treadboard extensions. The treadboard extensions associated with projections 80 and 82 have a triangular configuration extending past the normal front edge 62 on the side of the tread adjacent to the skirt by a dimension indicated by reference 88, such as 1.5 inches (38.1 mm). The treadboard projection then extends inwardly toward the front edge 62 along a line which forms an obtuse angle with the skirt portion which is ahead of the front edge of the step. This angle, indicated with reference numeral 84 in FIG. 2, is preferably 135°, but of course other obtuse angles may be used. If the angle 84 is 135°, the width dimension of the projection 80, indicated by reference 90, would be the same as dimension 88.

The cleats 68 and 70 of the treadboard are continued without interruption into the projection 80, with the projections 80 and 82 each having five tread cleats and four tread grooves, in the embodiment of the invention illustrated in the Figures.

The rear edge 67 of the treadboard 64 is also modified adjacent the skirts 60 and 60' to provide recesses which are sized to receive the projections 80 and 82 of the step 36'. Thus, each recess starts at the rear edge 67, at the dimension 90 from the sides of the step, and then the edge angles inwardly to intercept the side, a dimension 88' from the normal corner, which dimension is the same as dimension 88.

The riser 62 cooperates with the projecting portion of treadboard 64 to form the projections 80 and 82, with the riser 62 extending outwardly from its usually smoothly curved configuration to meet the treadboard projections and thus provide coved corners or fillets between the skirt boards and riser which eliminate the usual 90° angles between the riser and skirt boards, substituting the obtuse angle indicated by reference 84, such as 135°. Thus, the tendency for objects to become wedged between the skirt and riser is greatly reduced, as is the possibility of wedging objects between the skirt, riser, and treadboard of the next adjacent step, as the steps change from the step to the platform mode before entering the comb plates at each landing. The coved corner on the escalator steps is particularly effective in preventing soft, pliable, articles from being pulled between the step and skirt when the article is partially on the top of the step, adjacent the skirt, and partially overhanging the leading edge of the step. Relative motion between the coved corner and skirt provides a force component which pushes such an article away from the skirt along the angle of the coved corner. In order words, instead of a force against the article which tends to force the article straight back along the line of motion of the stairway, the article is pushed against the coved corner and thus along the coved corner away from the skirt.

As illustrated in the side elevational view of step 36 in FIG. 4, the curved configuration of the normal riser, indicated by arrow 96, is also provided on the riser extensions indicated by arrow 98. The vertically extending riser cleats 72 and 74 are also continued without interruption on the outwardly extending projections of the riser. Thus, the meshing of the cleats and grooves of the treadboard of one step with the riser of an adjacent step is maintained between the projections and recesses of adjacent steps, to provide the same close clearance between the steps in the area of the projections and recesses as maintained between other portions of adjacent steps.

Each step 36 also includes right and left hand step brackets 100 and 102, respectively, which may be separate assemblies to which the tread and riser parts are attached, or which may be formed integrally with the tread and riser parts. The step brackets, such as step bracket 102, each include a clamping assembly 104 for clamping the step to a step axle 39 shown in FIG. 1. The clamping assembly 104 may be the clamping means illustrated in my U.S. Pat. No. 3,789,972, and will not be described in detail. The forward portion of the step brackets, adjacent the riser portion of the step, include trailer wheel axle supports or arms 106 and 108 for receiving the axle and trailer wheel, such as axle 110 and trailer wheel 41, which are shown assembled with the axle support 106 in FIG. 3.

The unitary step concept disclosed in U.S. Pat. No. 2,981,397 is preferred for practicing the invention, as the projections 80 and 82 may be integrally formed with the riser and tread parts. In this preferred embodiment, illustrated in FIGS. 2, 3, 4 and 5, right and left hand unitary sections 112 and 114 are provided, such as from die cast aluminum, with the right hand unitary section 112 providing integrally joined tread and riser parts which cooperate to integrally form the projection 82. The right hand step bracket 100 is also preferably integrally formed with the tread and riser parts of the unitary section 112. The left hand unitary section 114 similarly provides integrally joined tread and riser parts which cooperatively and integrally form the projection 80. The right and left hand unitary sections 112 and 114 may be directly joined together with four bolts to provide a step having the width of the two sections 112 and 114, and for step widths which exceed this dimension, a unitary center section 116 may be provided which is connected to the right hand section 112 with four bolts and to the left hand section with four bolts. The four bolts for connecting the left hand section to the central or intermediate section 116 are illustrated at 120, 122, 124 and 126. The apertures for receiving the bolts are integrally formed in the unitary sections, such that the apertures of adjacent sections are aligned with one another when the step sections are placed in side-by-side relation.

In summary, there has been disclosed new and improved transportation apparatus, such as movable stairway, in which the plurality of steps and the adjacent skirt boards all cooperate to provide coved corners between the skirt boards and the risers of the steps. The coved corners provide an obtuse angle, such as 135°, between the riser parts and the step boards, and thus discourages the wedging of objects between the skirt and riser. It also minimizes the possibility of an object from becoming wedged in the corner formed between the riser, treadboard and skirt, as the steps descend into platform mode at the comb plates.

I claim as my invention:

1. A moving stairway extending between upper and lower landings, comprising:

a plurality of similar steps disposed to travel between the landings in a load bearing run, motive means, said motive means being operable to cause said steps to descend and change from step mode to platform mode near the end of the load bearing run, and first and second stairway skirt boards disposed at opposite sides of the steps, each of said steps having a tread part having forward and rear edges and first and second sides, and a riser part which is disposed adjacent the forward edge of said tread part, each of said steps having first and second projecting portions disposed at the forward edge thereof adjacent to the first and second sides, respectively, which extend outwardly past the forward edge portion of the step which extends between said first and second projecting portions, forming obtuse angles between the first and second projecting portions and said forward edge portion of the step, said first and second projecting portions being cooperatively formed by both the tread and riser parts to provide a fillet between the riser part and the first and second stairway skirt boards.

2. The moving stairway of claim 1 wherein the tread part of each step includes first and second recesses at the rear edge thereof adjacent to its first and second sides, respectively, with the first and second recesses of each step being shaped to receive the first and second projecting portions, respectively, of the step immediately adjacent to the rear edge of its tread part.

3. The moving stairway of claim 1 wherein the riser and tread parts, including the first and second projecting portions, are of unitary construction.

4. The moving stairway of claim 1 wherein each step includes at least first and second sections of unitary construction disposed in side-by-side relationship, with the tread and riser parts of each section, including the associated projecting portion, being integral with one another.

5. The moving stairway of claim 1 wherein the tread part includes a plurality of cleats and grooves which extend in the direction of stairway movement, with the first and second projecting portions each including a tread portion which includes at least one cleat and groove.

6. The moving stairway of claim 5 wherein the first and second projecting portions each include a tread portion having a plurality of cleats and grooves.

7. The moving stairway of claim 5 wherein the riser part includes a plurality of cleats and grooves, with the riser portion of each of tread part to define the first and second projecting portions including at least one cleat and groove.

8. The moving stairway of claim 6 wherein the riser part includes a plurality of cleats and grooves, with the riser portion of the first and second projecting portions each including a plurality of cleats and grooves.

9. A moving stairway, comprising:

an endless belt, a supporting structure for said endless belt for guiding the endless belt in a load bearing and a return run, motive means for driving said endless belt, first and second skirt means mounted on said supporting structure in spaced relation to form substantially vertical walls along the edges of the load bearing run, a plurality of stairway steps mounted on said endless belt, with each of said steps including first and second side portions adjacent to the first and second skirt means, respectively, during the load bearing run, said motive means being operable to cause said steps to descend and change from step mode to platform mode near the end of the load bearing run of said endless belt, each of said stairway steps including tread and riser parts, first and second projections, said first and second projections including a riser portion adjacent each of said first and second side portions, respectively, said first and second projections extending forwardly from said riser part as the steps descend, with their riser portions forming obtuse angles with the adjacent skirt means ahead of the projections, and obtuse angles with said riser part.

10. The moving stairway of claim 9 wherein the tread part of each step includes first and second recesses for receiving the first and second projections, respectively, on the immediately adjacent step.

11. The moving stairway of claim 9 wherein the riser and tread parts, including the first and second projections, are of unitary construction.

12. The moving stairway of claim 9 wherein each step includes at least first and second sections of unitary construction disposed in side-by-side relationship, with the tread and riser parts of each section, including the first and second projections being integral with one another.

13. The moving stairway of claim 9 wherein the tread part includes a plurality of cleats and grooves which extend in the direction of stairway movement, with the first and second projections each including a tread portion which includes at least one cleat and groove.

14. The moving stairway of claim 13 wherein the the first and second projections each include a tread portion having a plurality of cleats and grooves.

15. The moving stairway of claim 13 wherein the riser part includes a plurality of cleats and grooves, with the riser portion of each of the first and second projections including at least one cleat and groove.

16. The moving stairway of claim 14 wherein the riser part includes a plurality of cleats and grooves, with the riser portions of the first and second projections each including a plurality of cleats and grooves.

* * * * *